US005971655A

United States Patent [19]

Shirakawa

[11] Patent Number: 5,971,655

[45] Date of Patent: Oct. 26, 1999

[54] CONNECTION STRUCTURE OF DECKINGS

[75] Inventor: Mitsuya Shirakawa, Osaka, Japan

[73] Assignee: Miyagawa Kasei Industry Co., Ltd., Osaka, Japan

[21] Appl. No.: 09/009,712

[22] Filed: Jan. 20, 1998

[30] Foreign Application Priority Data

Aug. 19, 1997 [JP] Japan ..... 9-222364(P)

[51] Int. Cl.[6] ..... E01C 5/00; E01C 11/02; E01C 11/04

[52] U.S. Cl. ..... 404/40; 404/34; 404/41; 404/47; 404/50

[58] Field of Search ..... 404/17, 34, 40, 404/41, 47, 50, 53, 73

[56] References Cited

U.S. PATENT DOCUMENTS

| | | | |
|---|---|---|---|
| 1,730,259 | 10/1929 | Wright | 404/40 |
| 2,377,211 | 5/1945 | Cocken, Jr. | 404/40 |
| 3,202,067 | 8/1965 | Michard et al. | 404/17 |
| 3,487,756 | 1/1970 | Glaza et al. | 404/41 |
| 3,775,918 | 12/1973 | Johnson | 52/169 |
| 3,841,776 | 10/1974 | Klaus | 404/41 |
| 3,859,000 | 1/1975 | Webster | 404/41 |
| 4,465,398 | 8/1984 | Knudsen | 405/16 |
| 4,509,930 | 4/1985 | Schweigert et al. | 446/109 |
| 4,568,584 | 2/1986 | Holland | 428/44 |
| 4,577,448 | 3/1986 | Howorth | 52/584 |
| 5,050,362 | 9/1991 | Tal et al. | 52/588 |
| 5,685,666 | 11/1997 | Marshall et al. | 404/40 |
| 5,816,738 | 10/1998 | Harnapp | 404/18 |

*Primary Examiner*—Thomas B. Will
*Assistant Examiner*—Gary S. Hartmann
*Attorney, Agent, or Firm*—W. F. Fasse; W. G. Fasse

[57] ABSTRACT

Deckings include an upward hook and a receptacle. The upward hook is inserted into the receptacle. The receptacle has an opening immediately below a sidewall upper end portion that is continuous with the upper surface of the decking. The space between the deckings is restrained by engaging a tip of the upward hook behind the sidewall upper end. A fixture is mounted on the connection of the deckings. A base plate of the fixture extends from the portion of the deckings below the upward hook to the portion of the deckings below the receptacle. The base plate is fixed to the decking by a male screw, whereby downward movement of the upward hook is restricted.

8 Claims, 5 Drawing Sheets

CONNECTION STRUCTURE OF DECKINGS

BACKGROUND OF THE INVENTION

1. Field of the Invention

The present invention relates to a connection structure of deckings which is placed on the ground for use as a temporary path for a vehicle, for example on a construction site.

2. Description of the Background Art

It is conventionally known to place a decking on the ground for use as a temporary path for a vehicle or the like, for example on a construction site. A plurality of such deckings are usually combined together for use, for example, on a construction site. Conventionally, a plurality of deckings have generally been simply arranged for use.

However, the above mentioned simple arrangement of the deckings may often cause a displacement in position of the deckings and a gap between the deckings when the vehicle or the like passes on the deckings. Thus, a troublesome operation for correcting the displacement in position of the deckings has been often required. One possible method to avoid such a complicated operation is to connect the deckings. In this case, however, damage may be caused in the connection between the deckings.

SUMMARY OF THE INVENTION

The present invention is made to solve the above mentioned problem. It is an object of the present invention to provide a connection structure of deckings capable of improving reliability of connection between deckings.

The connection structure of deckings in accordance with the present invention is for first and second deckings having the following configurations. The first decking includes a receiving portion (a receptacle) opened at a side end with a remaining upper sidewall portion of the side end continuous to an upper surface of the decking, and adapted for receiving an upward hook of the second decking. The second decking includes an upward hook laterally protruding from a side end with a tip thereof directed upward. By inserting the above mentioned upward hook into the receptacle, upward movement of the upward hook is restricted by the upper end of the sidewall, and separation of the first and second deckings from each other is restrained due to engagement of the tip of the upward hook and the upper end of the sidewall.

As in the foregoing, with the first decking having the upward hook and the second decking having the upper end of the sidewall above the opening for the receptacle, the tip of the upward hook can be engaged with the upper end of the sidewall when the upward hook is inserted into the receptacle. Thus, separation of the first and second deckings (backward and forward movement) can be restricted. In addition, the upward hook is covered by the second decking as the upward hook is inserted into the receptacle. Thus, the upward hook is protected by the second decking even when a vehicle or the like passes over the connection between the first and second deckings. As a result, reliability in the connection between the first and second deckings is improved. Further, with the upper end of the sidewall being arranged above the upward hook, upward movement of the upward hook can be restricted. The wall surface of the second decking which defines opposite side ends of the above mentioned opening can restrict movement of the upward hook in leftward and rightward directions which are orthogonal to the backward and forward directions. Therefore, a connection structure capable of restricting backward and forward, leftward and rightward, and upward and downward movement of the first decking with respect to the second decking, and improving reliability in the connection between the first and second deckings, can be obtained.

It is noted that the upper surface of the above mentioned upward hook may preferably be inclined and the back surface of the upper end of the sidewall is provided with a plurality of ribs which are to abut against the inclined surface.

As mentioned above, the inclined upper surface of the upward hook facilitates insertion of the upward hook into the receptacle. In addition, a plurality of ribs provided on the back surface of the upper end of the side wall function as guides in inserting the upward hook, thereby further facilitating the above mentioned inserting operation. Further, due to the plurality of ribs, not only the tip but also the inclined surface of the upward hook can be engaged with the upper end of the sidewall. Thus, a contact area between the upper end of the sidewall and the upward hook is increased, allowing tight engagement of the upper end of the sidewall and the upward hook. As a result, the first and second deckings are more tightly connected, so that reliability in the connection between the first and second deckings is further increased.

First and second through holes may be respectively formed on the surfaces of the first and second deckings. In this case, the engagement between the upward hook and the upper end of the sidewall can be retained using a fixture having first and second protrusions inserted into the first and second through holes, a base connecting the first and second protrusions, and a fixing member, which is mounted at least on one of the first and second protrusions so that it pinches at least one of the first and second deckings with the base.

As mentioned above, by inserting the first and second protrusions of the fixture into the first and second through holes formed in the first and second deckings, the base of the fixture extends over the surfaces of both first and second deckings. The fixing member is then mounted at least on one of the first and second protrusions. When the base extends over the back surface of the first decking (below the upward hook), for example, the fixing member may be simply mounted on the second protrusion from the side of the upper surface of the second decking. Then, the fixture is fixed to the second decking by the fixing member, so that downward movement of the first decking can be prevented by the base of the fixture. Thus, the engagement between the upward hook and the upper end of the sidewall is retained. On the other hand, when the base extends over the upper surface of the first decking (above the upward hook), the fixing member may be simply mounted on the first protrusion. In this case, the base extends above the receptacle or above the upper surface of the second decking, and the fixture is fixed to the first decking. Downward movement of the first decking can be prevented by the base of the fixture which extends above the upper surface of the second decking, so that the engagement between the upward hook and the upper end of the sidewall can be retained. It is noted that the engagement between the upward hook and the upper end of the sidewall can also be retained by mounting fixing members both on the first and second protrusions. However, by mounting a fixing member only on one of the first and second protrusions as in the foregoing, the number of fixing members and cost are reduced. In addition, when the base is arranged below the first and second deckings, a connection between the first and second protrusions and the base as well as the base itself are protected by the first and second deckings. Further, the connection between the first or second protrusion and the fixing member can be arranged in the first or second through hole. In this case, the connection can be protected by the first or second decking. This is also contributable to increased reliability of the connection.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Referring to FIGS. 1 to 8, an embodiment of the present invention will now be described.

Figure 1:
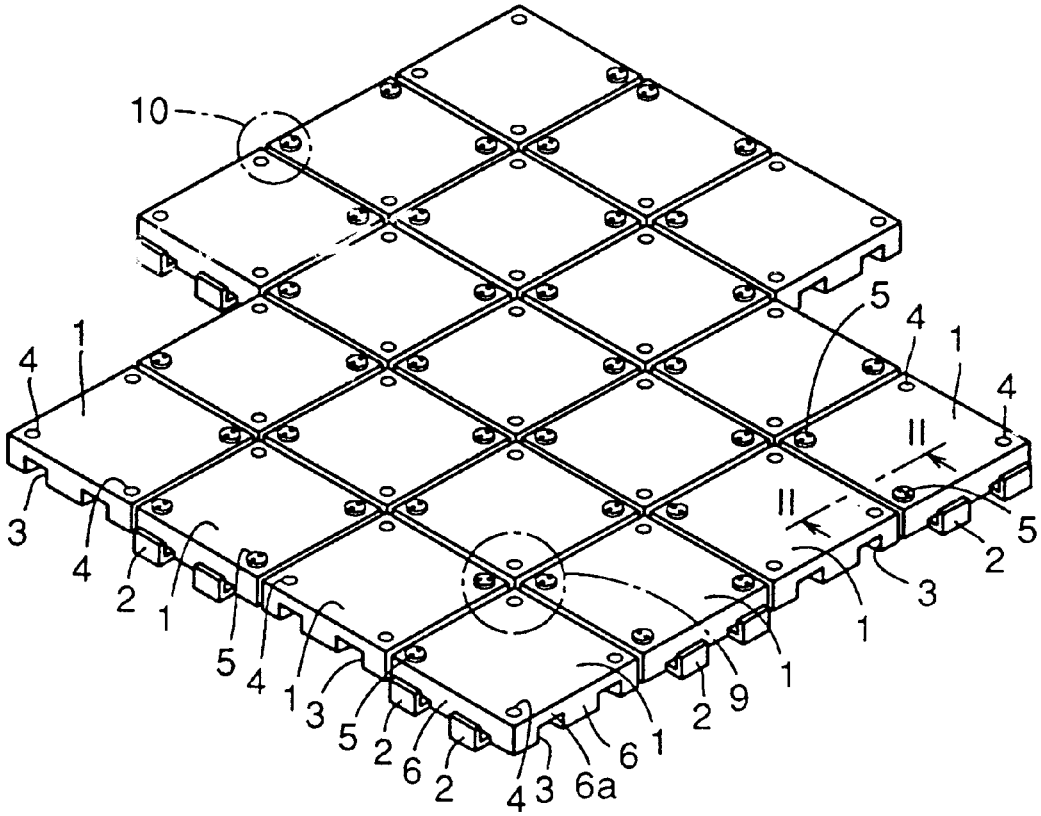
FIG. 1 is a perspective view showing a connection structure of deckings according to an embodiment of the present invention.

FIG. 1 is a perspective view showing a connection structure of deckings 1 according to the embodiment of the present invention.

As shown in FIG. 1, decking 1 formed of resin such as polypropylene includes an upward hook 2, a receptacle 3 and a through hole 4. Upward hooks 2 are provided on a pair of opposing sidewalls 6 in decking 1. Upward hook 2 is inserted into receptacle 3 of adjacent decking 1, and the engagement therebetween is maintained by a fixture which will be later described. Receptacles 3 are provided on a pair of sidewalls 6 which are adjacent to the pair of sidewalls 6 on which the upward hooks are provided, and having an opening in sidewall 6 leaving a sidewall upper end 6*a* which is continuous to the upper surface of decking 1. Formed on the upper surface of decking 1 is through hole 4, into which is screwed a male screw 5 for fixing a fixture, which will be described later, and decking 1.

Figure 2:
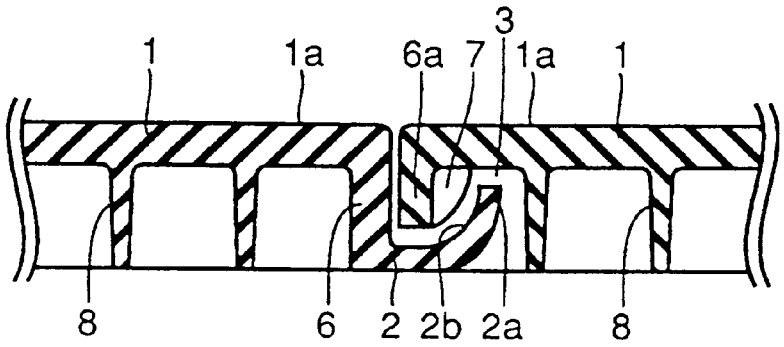
FIG. 2 is a cross sectional view showing in enlargement a cross section taken along line II—II in FIG. 1.

FIG. 2 shows a cross section taken along line II—II in FIG. 1. Referring to FIG. 2, the structure of upward hook 2 and receptacle 3 will be described in detail.

As shown in FIG. 2, decking 1 has a hollow structure, in which a rib 8 is selectively provided. Upward hook 2 laterally protrudes from sidewall 6 of decking 1 and has its tip 2*a* directed upward. Upward hook 2 has an inclined upper surface 2*b*. Inclined surface 2*b* facilitates insertion of upward hook 2 into receptacle 3.

An opening for receptacle 3 is located immediately below sidewall upper end 6*a* continuous from an upper surface 1*a* of decking 1. Upward hook 2 would be inserted into receptacle 3 from tip 2*a* through the opening. Thus, tip 2*a* of upward hook 2 can be engaged with sidewall upper end 6*a*, restraining the separation between adjacent deckings 1. In addition, upward movement of upward hook 2 is prevented by sidewall upper end 6*a*. Further, upward hook 2 is protected by decking 1 as it is covered by decking 1. Therefore, increased reliability of the connection of deckings 1 is achieved.

A plurality of ribs 7 are provided on the back surface of sidewall upper end 6*a*. In this case, a plurality of ribs 7 are provided along a direction which is perpendicular to the sheet of the drawing. The surface of rib 7 is preferably a curved surface having curvature which approximates to that of inclined surface 2*b* of upward hook 2. Thus, in engaging the upward hook 2 with the sidewall upper end 6*a*, not only tip 2*a* but also inclined surface 2*b* of upward hook 2 can be engaged with sidewall upper end 6*a*. As a result, the contact area between upward hook 2 and sidewall upper end 6*a* is increased, facilitating tight engagement between upward hook 2 and sidewall upper end 6*a*. This also contributes to increased reliability of the connection for deckings 1.

In addition, the surface of rib 7 can function as a guide in inserting upward hook 2 into receptacle 3. Thus, the insertion of upward hook 2 into receptacle 3 is further facilitated.

Figure 7:
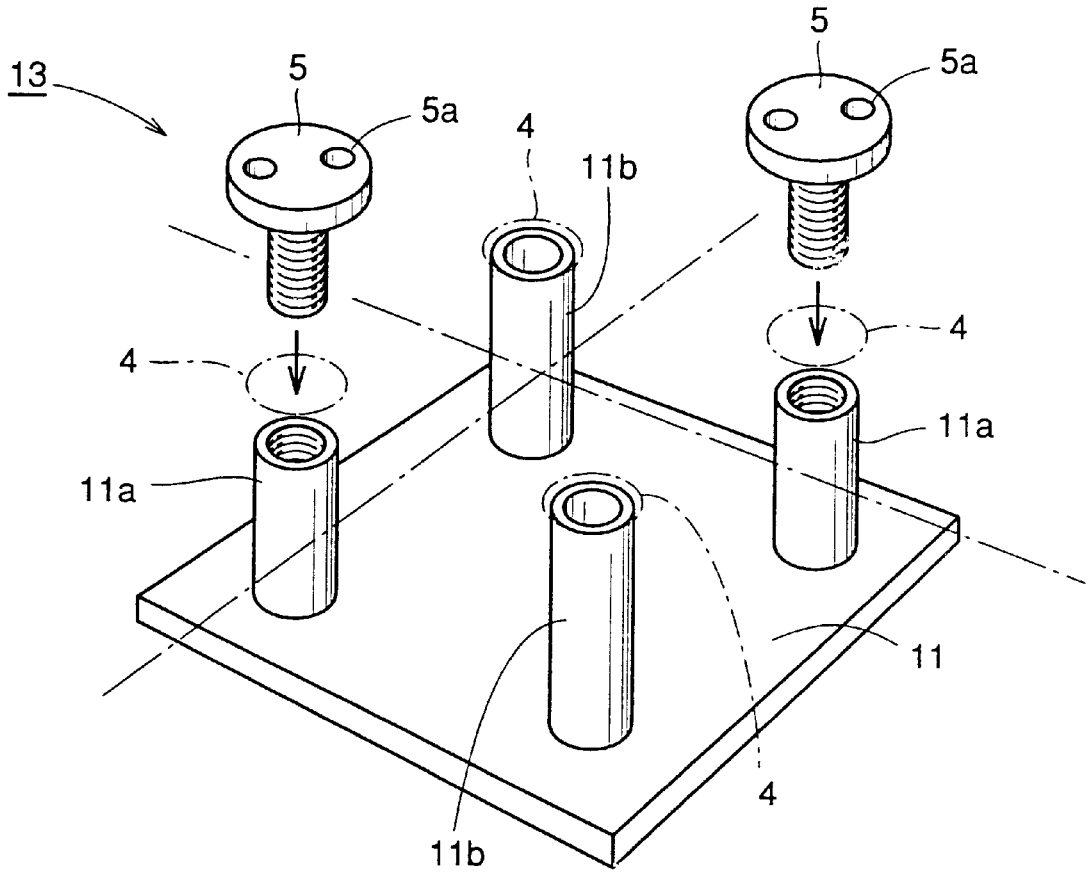
FIG. 7 is a perspective view showing one example of a fixture which can be used in the connection structure of the deckings according to the present invention.
Figure 8:
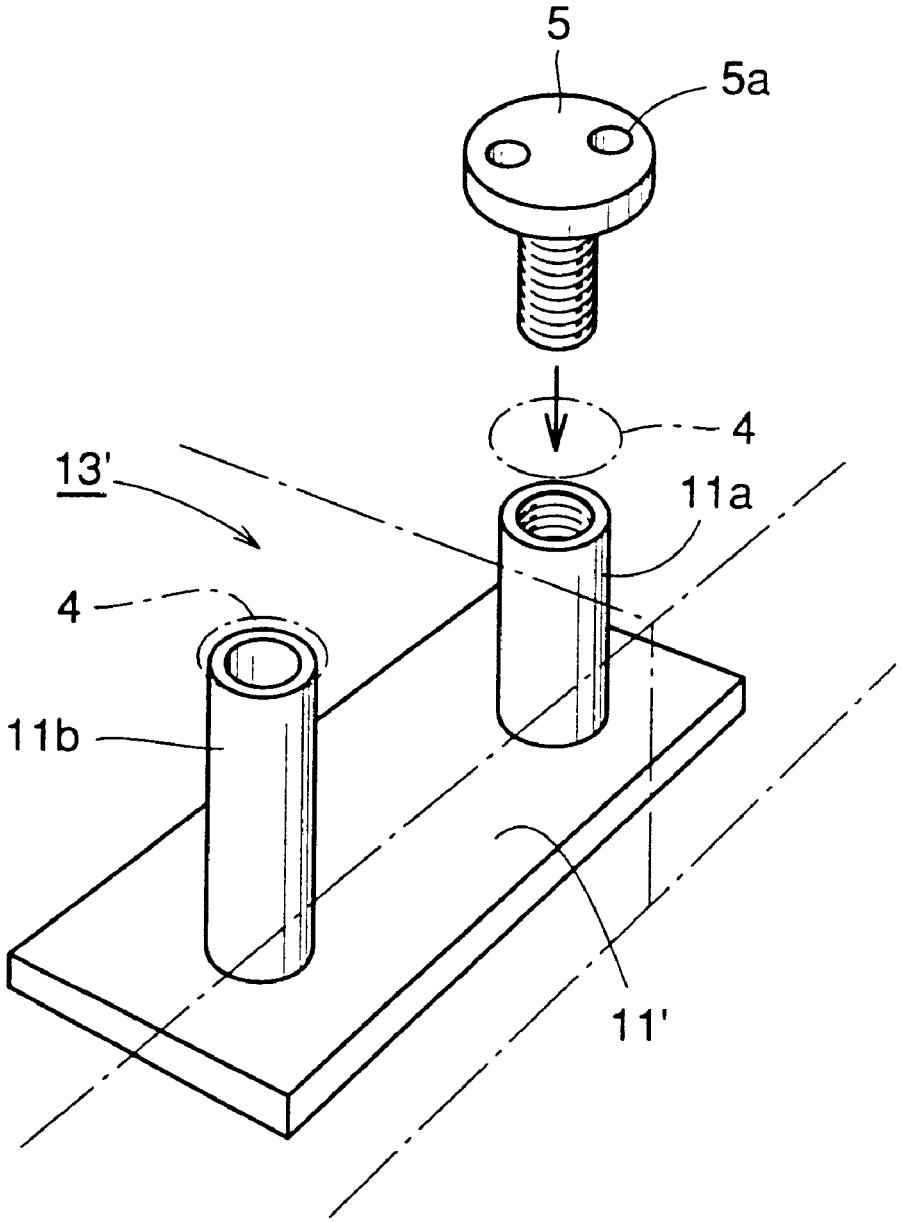
FIG. 8 is a perspective view showing another example of the fixture which can be used in the connection structure of the deckings according to the present invention.

Now, referring to FIGS. 7 and 8, the fixture which can be used in connecting deckings 1 according to the present invention will be described. FIGS. 7 and 8 are perspective views showing fixtures 13 and 13' of two types, which can be used in connecting deckings 1 according to the present invention.

Fixture 13 shown in FIG. 7 can be used inside the connection structure, for example at a region 9 in FIG. 1. Fixture 13 includes a base plate 11 made for example of metal, and four tube like portions (protrusions) provided on base plate 11. More specifically, provided on base plate 11 are a relatively short first pair of tube like portions 11*a* and a relatively long second pair of tube like portions 11*b*.

First and second tube like portions 11*a* and 11*b* are alternately arranged along the periphery of base plate 11 such that a first imaginary line between first tube like portions 11*a* intersects with a second imaginary line between second tube like portions 11*b*.

A female screw threading is formed on the inner surface of first tube like portions 11*a*, in which the male screws 5, which function as fixing members are received. A male screw 5 has its head provided with a pair of holes 5*a* for rotating male screw 5. The female screw threading is not formed on the inner surface of second tube like portion 11*b*. As shown in FIG. 7, forming the female screw threading only on first tube like portions 11*a* reduces the cost for manufacturing fixture 13. In addition, the number of male screws 5 can be reduced, achieving further reduction in cost.

Referring now to FIG. 8, fixture 13' shown in FIG. 8 can be used for example in region 10 shown in FIG. 1. In other words, fixture 13' can be used in the periphery of the connection structure of deckings 1.

Fixture 13' includes a base plate 11' and first and second tube like portions 11*a* and 11*b* provided on base plate 11'. It is noted that the female screw threading may be formed on the inner surface of the above mentioned second tube like portion 11*b*, and male screw 5 can be screwed therein. Also, second tube like portion 11*b* can be solid rather than hollow. In addition, any fixing member other than male screw 5 can be used. For example, a fixing member which can be simply forced into and engaged with first tube like portion 11*a* may be used.

Figure 3:
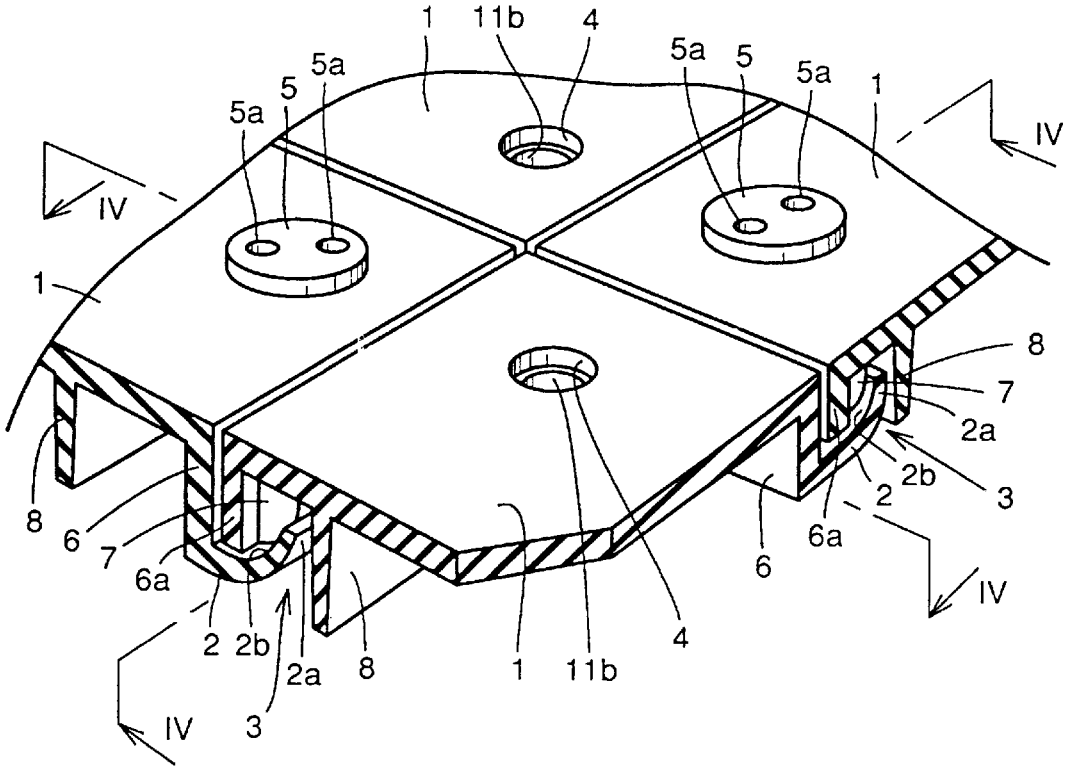
FIG. 3 is a partially sectional perspective view showing in enlargement a region 9 in FIG. 1.
Figure 4:
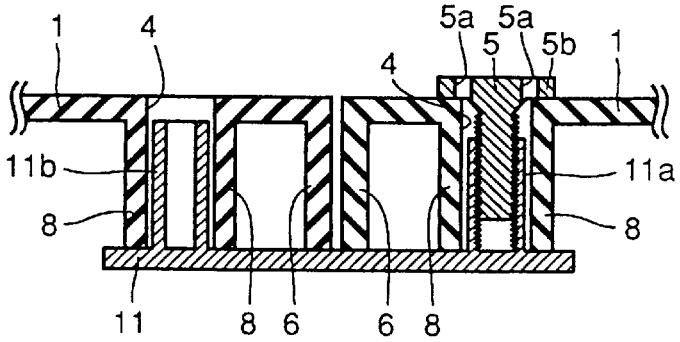
FIG. 4 is a cross sectional view taken along line IV—IV in FIGS. 3 and 5.
Figure 5:
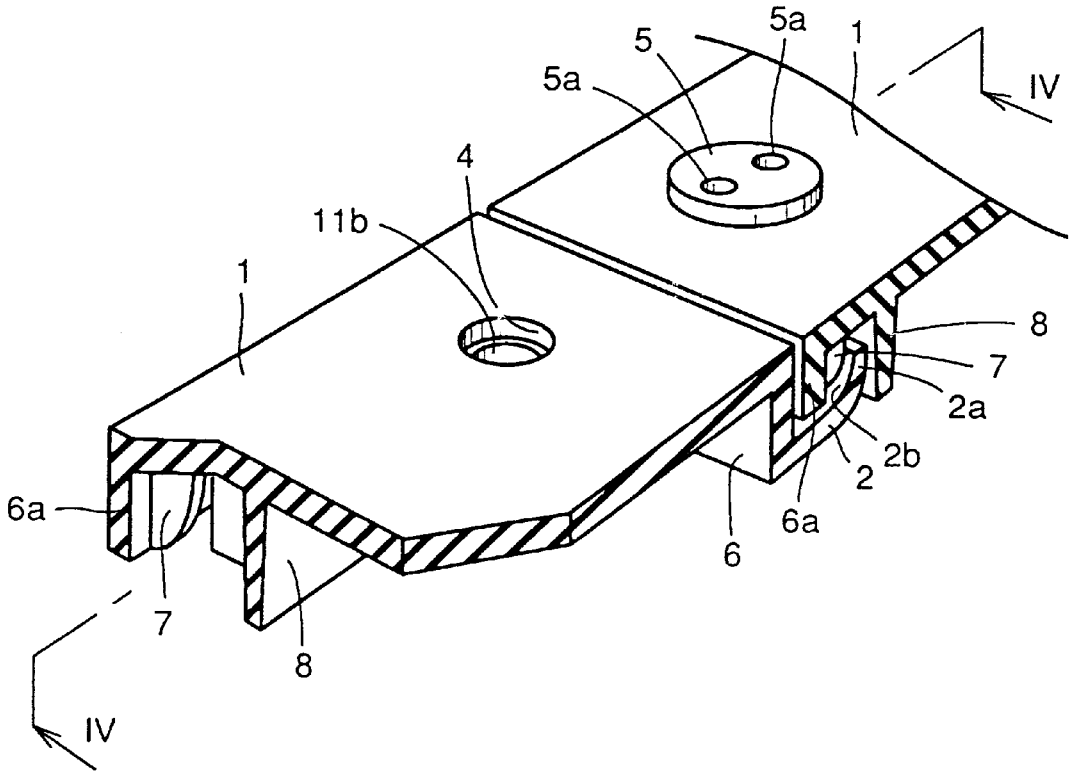
FIG. 5 is a partially sectional perspective view showing in enlargement region 10 in FIG. 1.

Referring now to FIGS. 3 to 5, a connection structure of deckings 1 using the above mentioned fixtures 13 and 13' will be described. FIG. 3 is a partially sectional perspective view of the connection structure of deckings 1 using fixture 13, showing in enlargement a region 9 in FIG. 1. FIG. 5 is a partially sectional perspective view of the connection structure of deckings 1 using fixture 13', showing in enlargement a region 10 in FIG. 1. FIG. 4 is a cross section taken along line IV—IV in FIGS. 3 and 5.

Referring first to FIG. 3, corners of deckings 1 are provided with through holes 4 on the upper surface of deckings 1. First and second tube like portions 11*a* and 11*b* of fixture 13 are inserted into through holes 4. Male screw 5 is screwed into first tube like portion 11*a*. More specifically, male screw 5 is screwed into tube like portion 11*a* such that decking 1 is pinched between the head 5*b* of male screw 5 and base plate 11.

Here, base plate 11 extends below upward hook 2 (on the back surface of decking 1). Base plate 11 is fixed to decking 1 by male screw 5. Thus, downward movement of upward hook 2 can be prevented by base plate 11. Engagement between upward hook 2 and sidewall upper end 6*a* is thereby retained.

Referring now to FIG. 4, cross sectional structure of the connection of deckings 1 including fixture 13 will be described. As shown in FIG. 4, first and second tube like portions 11*a* and 11*b* are provided on base plate 11 to be approximately parallel. Such first and second tube like portions 11*a* and 1*b* inserted into through holes 4 of a set of adjacent deckings 1 contribute to restrain separation between the set of deckings 1. Male screw 5 is screwed into first tube like portion 11*a*, and decking 1 is pinched between head 5*b* of male screw 5 and base plate 11. As base plate 11 is arranged below the back surface of decking 1, a connection between base plate 11 and first and second tube like portions 11*a* and 11*b* as well as base plate 11 itself can be protected by decking 1. In addition, the connection between male screw 5 and first tube like portion 11*a* is located in through hole 4. These features all contribute to a increase in reliability of the connection of deckings 1.

Second tube like portion 11*b* functions as a guide in inserting fixtures 13 and 13' into decking 1. While the height of second tube like portion 11*b* is arbitrarily selected, it is preferably equal to or smaller than the depth of through hole 4 and larger than the height of first tube like portion 11*a*. Thus, second tube like portion 11*b* can function more effectively as a guide, and, in addition, this difference in length facilitates discrimination between the first and second tube like portions 11*a* and 11*b* when the fixture is to be mounted and male screw 5 is to be screwed therein.

Referring now to FIG. 5, also in this case, base plate 11' of fixture 13' extends to the lower portion of upward hook 2 as in FIG. 3. Downward movement of upward hook 2 is thereby prevented. Thus, engagement between upward hook 2 and sidewall upper end 6*a* can be retained.

Figure 6:
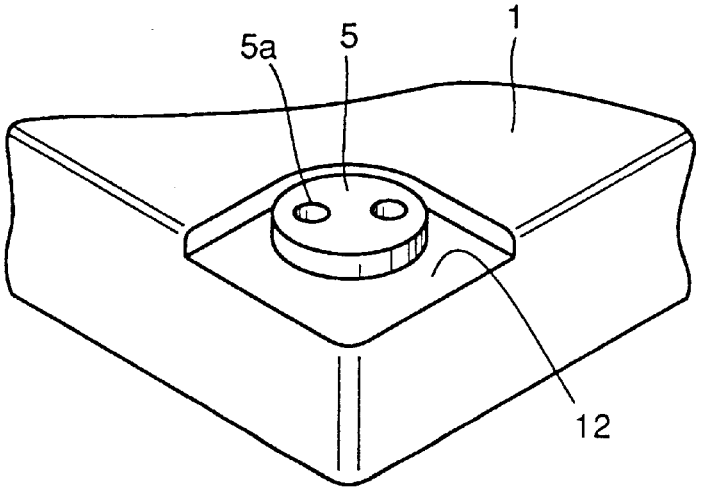
FIG. 6 is a perspective view showing a variation of a structure at a corner of the decking according to the present invention.

Referring now to FIG. 6, a variation of a corner of decking 1 will be described. As shown in FIG. 6, a concave portion 12 for receiving the head 5*b* of male screw 5 may be formed at the corner of decking 1. It is preferable that the depth of concave portion 12 is approximately the same as or larger than the thickness of head 5*b* of male screw 5. Thus, protrusion of head 5*b* of male screw 5 above the upper surface of decking 1 can be effectively prevented. This helps to ensure a flat or planarized upper surface of decking 1. In addition, any externally applied force is not concentrated at male screw 5, so that fixtures 13 and 13' are protected.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A combination of a first decking member, a second decking member and a fixture that are adapted to be connected to each other, wherein:

said first decking member has a first top surface with a first hole therethrough, a first side end, and a hook that protrudes laterally from said first side end and terminates in an upward directed tip;

said second decking member has a second top surface with a second hole therethrough, a sidewall at a second side end of said second decking member, a receptacle therein, an opening provided in said sidewall so as to open into said receptacle and so as to leave an upper portion of said sidewall remaining continuous with said second top surface between said opening and said second top surface, wherein said opening and said receptacle are adapted to receive said hook reaching through said opening with said upward directed tip of said hook received in said receptacle adjacent a back surface of said upper portion of said sidewall facing said receptacle; and said fixture comprises a hollow first protrusion that has an open first end and a female screw threading provided on an inner surface of said hollow first protrusion and that is adapted to be inserted in one of said first and second holes, a second protrusion that is longer than said first protrusion and that is adapted to be inserted in another of said first and second holes other than said one of said first and second holes, a fixture base connected to and interconnecting said first and second protrusions, and a bolt that is adapted to extend into said one of said first and second holes and that has a male screw threading adapted to be screwed through said open first end into engagement with said female screw threading of said hollow first protrusion.

2. The combination according to claim 1, in a connected state in which said first and second decking members are adjacent one another with said first side end of said first decking member adjacent said second side end of said second decking member, said hook reaches through said opening with said upward directed tip received in said receptacle along and adjacent said back surface of said upper portion of said sidewall, said hollow first protrusion extends into said second hole from a first side of said second decking member, said second protrusion extends into said first hole from a first side of said first decking member corresponding to and coplanar with said first side of said second decking member, and said bolt extends into said second hole from a second side of said second decking member opposite said first side and is arranged with said male threading engaged in said female threading of said hollow first protrusion so that said bolt pinches said second decking member against said fixture base on said first side of said second decking member, wherein an upward movement of said first decking member relative to said second decking member is restricted by said hook contacting said upper portion of said sidewall, a downward movement of said first decking member relative to said second decking member is restricted by said fixture base that spans across said first and second decking members on said first sides thereof, and a movement of said first decking member separating away from said second decking member is restricted by said upward directed tip of said hook contacting said back surface of said upper portion of said sidewall of said second decking member.

3. The combination according to claim 1, wherein said upper portion of said sidewall includes a wall member and a plurality of ribs protruding from said wall member into said receptacle, wherein said ribs form said back surface of said upper portion of said wall member, and wherein said hook includes an inclined upper surface sloping up to said upward directed tip and said inclined upper surface abuts against said back surface formed by said ribs.

4. The combination according to claim 1, wherein said second protrusion is hollow and has an open second end, and wherein said hollow second protrusion does not have a female screw threading provided therein.

5. The combination according to claim 1, wherein said fixture base comprises a plate having a main surface, and said first and second protrusions extend from said main surface parallel to each other and spaced apart from each other.

6. The combination according to claim 5, further comprising another one of said first protrusion and another one of said second protrusion, wherein all of said protrusions extend from said main surface of said plate parallel to each other and spaced apart from each other, and wherein said protrusions are respectively located at imaginary corners of an imaginary quadrangle such that an imaginary first line extending between said first protrusions intersects an imaginary second line extending between said second protrusions.

7. The combination according to claim 1, wherein said second top surface of said second decking member has a concave portion therein around said second hole, and wherein said concave portion has a depth measured from said second top surface to a floor of said concave portion that is greater than a protrusion height of said bolt above said floor when said bolt is engaged with said male threading in said female threading.

8. A combination of a first decking member, a second decking member and a fixture that are adapted to be connected to each other, wherein:

said first decking member has a first top surface with a first hole therethrough, a first side end, and a hook that protrudes laterally from said first side end and terminates in an upward directed tip;

said second decking member has a second top surface with a second hole therethrough, a sidewall at a second side end of said decking member, a receptacle therein, an opening provided in said sidewall so as to open into said receptacle and so as to leave an upper portion of said sidewall remaining continuous with said second top surface between said opening and said second top surface, wherein said opening and said receptacle are adapted to receive said hook reaching through said opening with said upward directed tip of said hook received in said receptacle adjacent a back surface of said upper portion of said sidewall facing said receptacle; and said fixture comprises a hollow first protrusion that has an open first end and a female screw threading provided on an inner surface of said hollow first protrusion and that is adapted to be inserted in one of said first and second holes, a second protrusion that is adapted to be inserted in another of said first and second holes other than said one of said first and second holes, a fixture base connected to and interconnecting said first and second protrusions, and a bolt that is adapted to extend into said one of said first and second holes and that has a male screw threading adapted to be screwed through said open first end into engagement with said female screw threading of said hollow first protrusion, and wherein said second protrusion is not provided with a screw threading and is not adapted to be engaged by said bolt.

* * * * *